US005209249A

United States Patent [19]

Neri

[11] Patent Number: 5,209,249

[45] Date of Patent: May 11, 1993

[54] CIGARETTE CHECKING APPARATUS

[75] Inventor: Armando Neri, Bologna, Italy

[73] Assignee: G. D. Societá Per Azioni, Italy

[21] Appl. No.: 385,809

[22] Filed: Jul. 26, 1989

[30] Foreign Application Priority Data

Jul. 28, 1988 [IT] Italy ..... 3554 A/88

[51] Int. Cl.[5] ..... A24D 5/14; A24D 5/34; A24D 5/345

[52] U.S. Cl. ..... 131/282; 131/907; 131/908

[58] Field of Search ..... 131/282, 283, 280, 907, 131/908

[56] References Cited

U.S. PATENT DOCUMENTS 4,724,429 2/1988 Millen et al. ..... 131/280
4,856,538 8/1989 Focke et al. ..... 131/282

*Primary Examiner*—V. Millin
*Attorney, Agent, or Firm*—Gifford, Groh, Sprinkle, Patmore and Anderson

[57] ABSTRACT

A cigarette checking apparatus having a selector mechanism for selectively withdrawing cigarettes from a first transportation roller, transporting the cigarettes to a conveyor; and a second conveyor for transporting the selected cigarettes to a number of checking devices, each checking device checking a specific characteristic of the selected cigarette; the checking devices having independent inlets facing the second conveyor, and at least one of the checking devices having an outlet opening towards the first conveyor.

19 Claims, 7 Drawing Sheets

CIGARETTE CHECKING APPARATUS

BACKGROUND OF THE INVENTION

The present invention relates to a cigarette checking apparatus, particularly suited for location at the output of a filter assembly machine The cigarettes coming off a filter assembly machine are usually supplied to a packing machine on a conveyor belt on which they are stacked in a substantially uniform layer crosswise in relation to the traveling direction.

At the output of the filter assembly machine, the cigarettes are subjected to a series of checks to determine given geometrical and physical characteristics, such as length, diameter, ventilation, weight, firmness, etc. Should the results of said checks fail to conform with given reference data, they are interpreted by the operator for making appropriate adjustments, for example, to the cutters on the manufacturing and filter assembly machines, to the printing means, to the number of holes formed by the filter perforating means, etc. Correct interpretation of the data supplied by the checking devices naturally depends on correct interpretation of the faults detected during inspection. The problem of interpreting inspection data relative to cigarettes produced on single and, particularly, dual rod cigarette manufacturing machines, is solved by the cigarette sampling unit described in Italian Patent Application N.3386A/88 of Mar. 21, 1988 filed by the present Applicant and the content of which is included herein purely by way of reference as required. Said unit provides for selectively withdrawing cigarettes from a given location on the filter assembly machine, so that the exact origin of the sampled cigarette and the positions occupied by the same between the filter assembly machine and the input of the checking device are known.

A known checking device consists of a series of units arranged one on top of the other. Inside said device, each sample cigarette is fed downwards from one unit to the next, each of which provides for checking a given characteristic.

The time taken to check each cigarette therefore equals the total operating time of the various units, which is fairly lengthy. Moreover, no provision is made on said device for repeat checking a given characteristic to the exclusion of the others. A further point to note is that, should said device comprise a firmness testing unit, the cigarettes are usually subjected to destructive testing and consequently rejected.

SUMMARY OF THE INVENTION

The aim of the present invention is to provide a cigarette checking apparatus designed to overcome the aforementioned drawbacks, and which may be controlled automatically and selectively.

With this aim in view, according to the present invention, there is provided a cigarette checking apparatus, characterized by the fact that it comprises means for selectively withdrawing said cigarettes from first transportation means transporting said cigarettes to first conveying means to a subsequent operating machine; and second transportation means for transporting said selected cigarettes to a number of checking devices, said devices presenting independent inlets facing said second transportation means.

BRIEF DESCRIPTION OF THE DRAWINGS

Two preferred non-limiting embodiments of the present invention will be described by way of examples with reference to the accompanying drawings, in which.

DETAILED DESCRIPTION OF THE INVENTION

Figure 1:
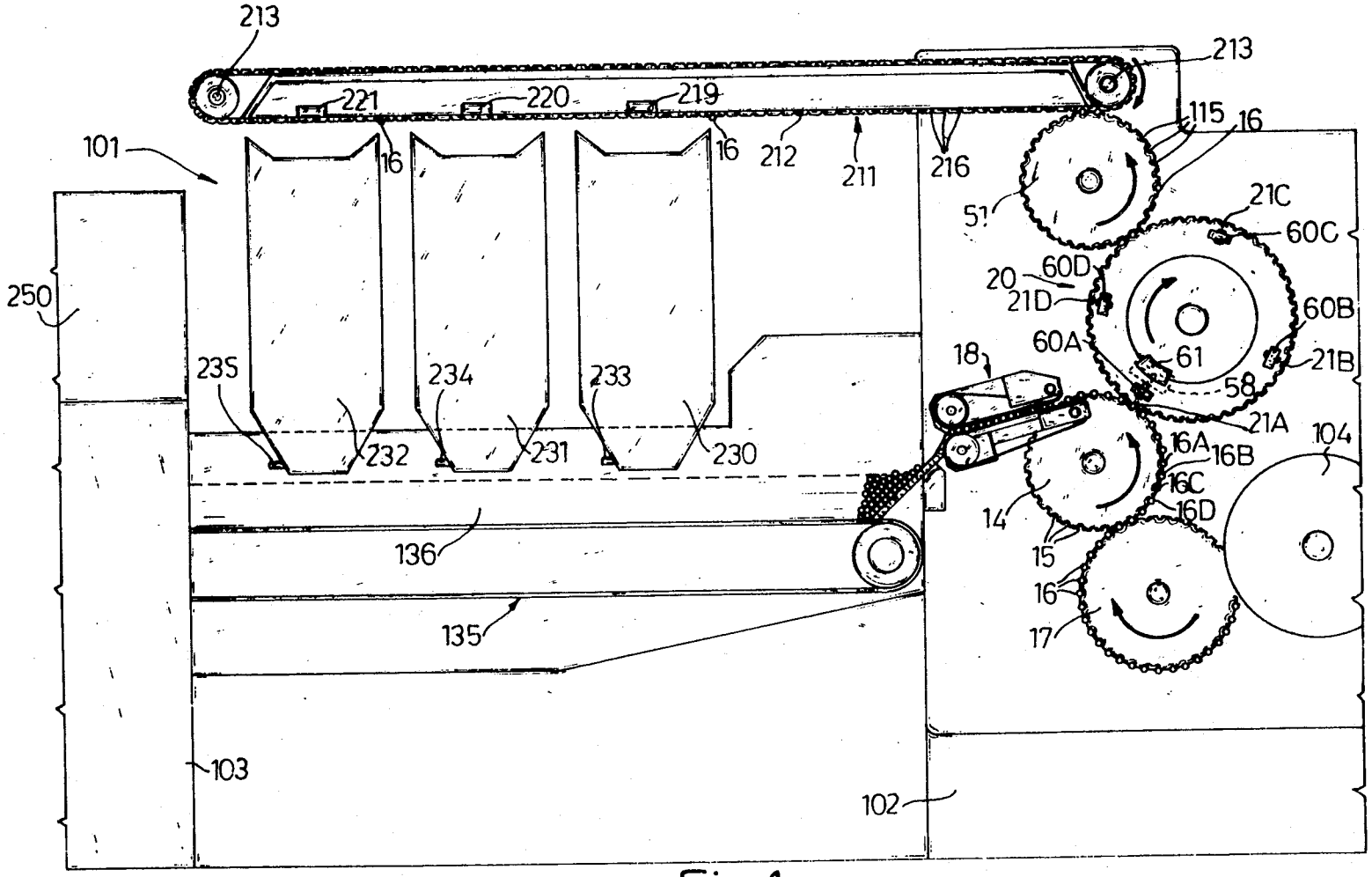
FIG. 1 shows a schematic front view of an apparatus in accordance with the teachings of the present invention.
Figure 2:
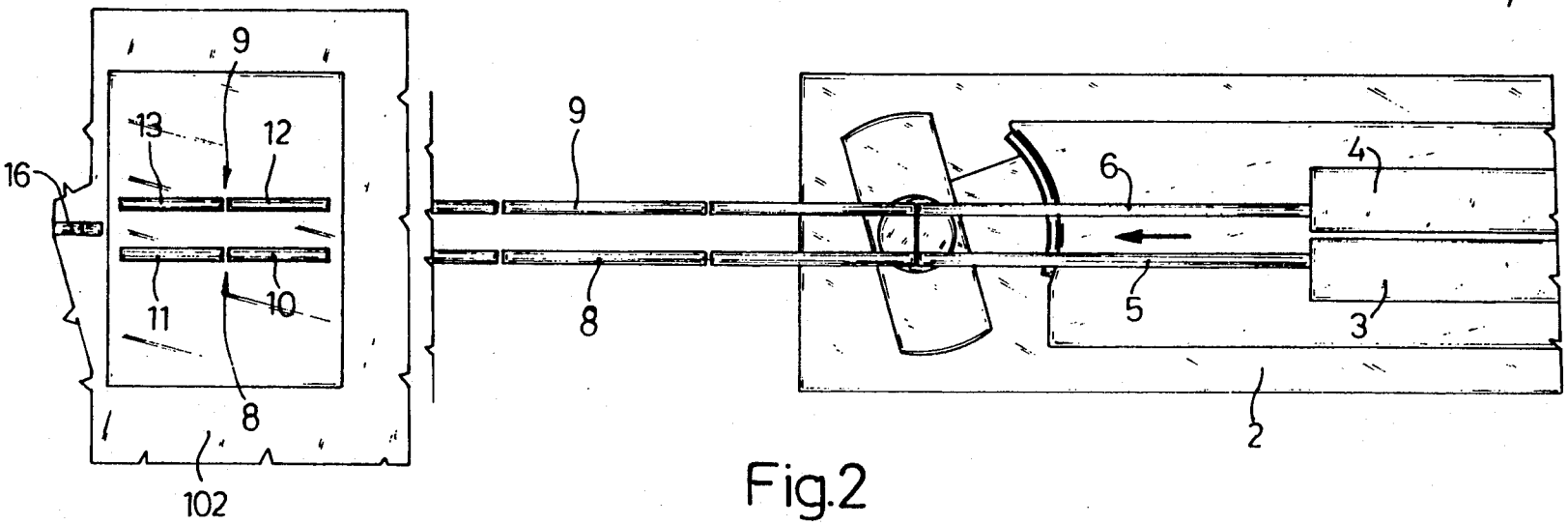
FIG. 2 shows a schematic top view of a cigarette manufacturing line connected to the FIG. 1 apparatus.

Number 101 in FIG. 1 indicates the checking apparatus according to the present invention, said apparatus being located parallel to the traveling direction between the output of a known filter assembly machine 102 and the input of a follow-up packing machine 103. As shown in FIG. 2, filter assembly machine 102 is supplied by a cigarette manufacturing line comprising a dual rod cigarette manufacturing machine 2, i.e. having two parallel lines 3 and 4 for producing respective rods 5 and 6. Filter assembly machine 102 is thus supplied with cigarette portions 8 and 9 twice as long as those required for producing a filter cigarette. On said machine 102, portion 8 is cut in known manner into halves 10 and 11, and portion 9 into halves 12 and 13. Said two halves of each two portions 8 and 9 are then parted so as to define a space in which to accommodate a double filter, which is first connected to said two halves by means of a strip, and then cut in half to produce a succession of single cigarettes 16 which are fed to a roller 104 (FIG. 1). Said filter assembly machine 102 presents an output portion having a supply roller 14 designed to successively receive cigarettes 16, inside a number of equally-spaced peripheral seats 15, from a tangent feed roller 17 in turn supplied by roller 104. Cigarettes 16 on roller 14 are then fed in known manner to a supply unit 18 by which they are fed on to a conveyor belt 135. On said conveyor belt 135, cigarettes 16 are arranged transversely in relation to the traveling direction of the conveyor, and stacked in a layer 136 of substantially uniform thickness, which is fed to packing machine 103. In FIG. 1, cigarettes 16 are numbered 16A, 16B, 16C and 16D depending on whether they consist of a half 10, 11, 12 or 13 of portions 8 and 9 (FIG. 2). To enable the type of cigarette 16 to be determined at all times, seats 15 and those formed on all the rollers (not shown) on machine 102 upstream from roller 17 are in multiples of 4, so that each seat 15 is always assigned the same type of cigarette 16.

Roller 14 is assigned a withdrawal unit 19 comprising a withdrawal roller 20 tangent to roller 14 and turning about its axis at the same speed as the same. Roller 20 presents a number of peripheral axial grooves, four of which, appropriately spaced about roller 20, constitute seats 21A, 21B, 21C and 21D for withdrawing respective cigarettes 16A, 16B, 16C and 16D, whereas the others constitute counterseats 22 enabling safe passage of cigarettes 16 between rollers 14 and 20. In this case also, the number of counterseats 22 between each pair of adjacent seats 21A, 21B, 21C and 21D is such that each of said seats 21A, 21B, 21C and 21D is always engaged by the same type of cigarette 16A, 16B, 16C, 16D.

Figure 3:
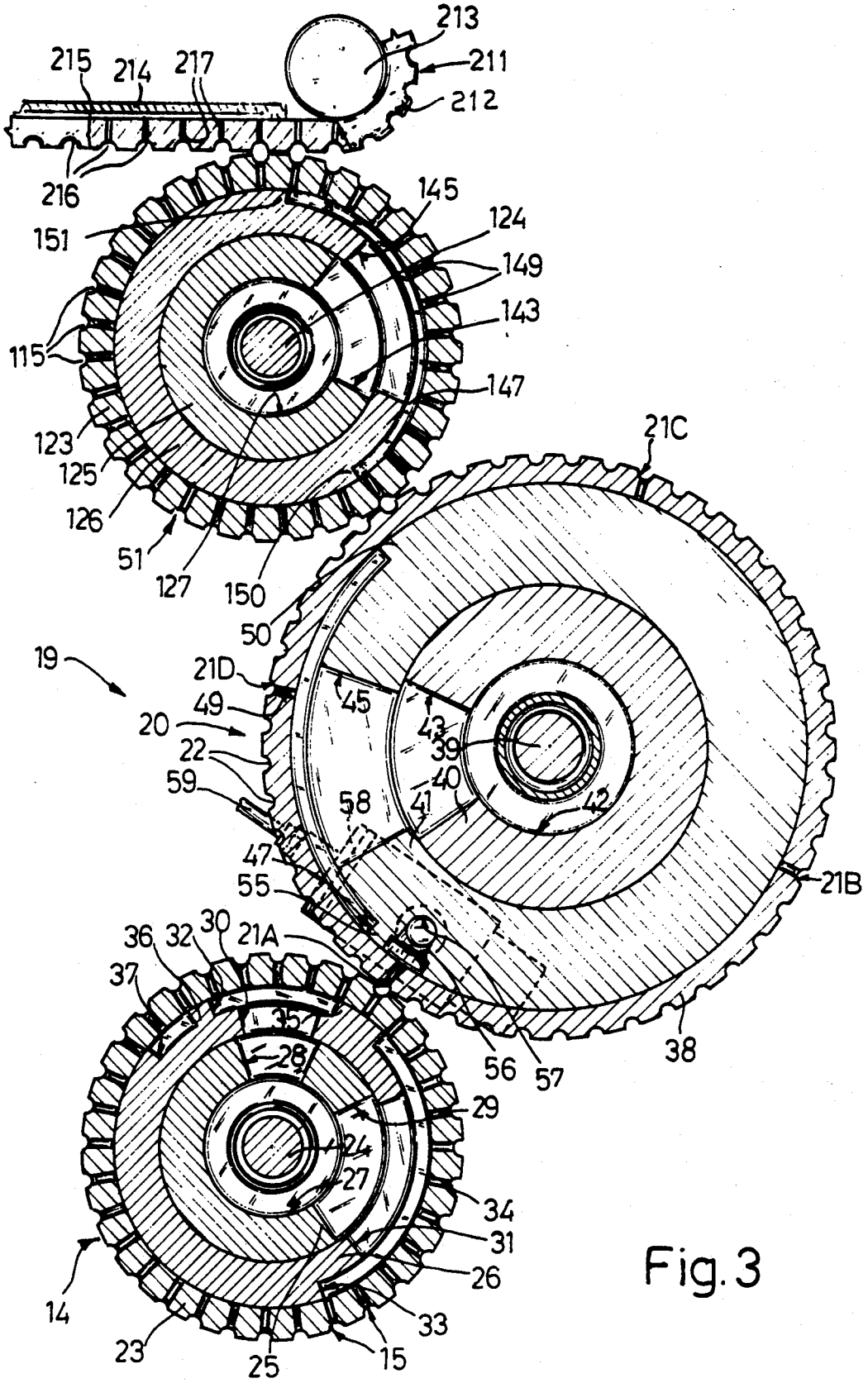
FIG. 3 shows a section of a selective withdrawal unit on the FIG. 1 apparatus.

As shown in FIG. 3, roller 14 comprises a rotary outer ring 23 having seats 15 and turned anticlockwise by a central shaft 24 supporting two fixed cylindrical distributors 25 and 26, the first 25 of which is located inside the second 26 and communicates via a central passage 27 with a suction device (not shown). Distributor 25 presents two through radial slots 28 and 29 communicating, on one side, with central passage 27 and, on the other, with two respective radial passages 30 and 31 on distributor 26, in turn communicating with respective outer chambers 32 and 33 defined between the outer edge of distributor 26 and the inner edge of ring 23. Chambers 32 and 33 communicate with seats 15 via radial channels 34 formed through ring 23, and are separated by a partition 35 over the outer edge of which the inner surface of ring 23 slides in substantially contacting manner. Partition 35 is located at the point of tangency between rollers 14 and 20, so as to successively cut off communication between each seat 15 and central passage 27 as seat 15 moves through the point of tangency between rollers 14 and 20.

A further partition 36 similar to 35 separates chamber 32 from a further chamber 37, which is completely isolated from central passage 27 and located at the point of connection between roller 14 and supply unit 18, so as to enable removal of the vacuum inside channels 34.

As shown in FIG. 3, roller 20 comprises a rotary outer ring 38 having seats 21A, 21B, 21C, 21D and counterseats 22, and turned clockwise by a central shaft 39 supporting two fixed cylindrical distributors 40 and 41, the first 40 of which is located inside the second 41 and communicates, via a central passage 42, with a suction device (not shown). Distributor 40 presents a through radial slot 43 communicating, on one side, with central passage 42 and, on the other, with a respective radial passage 45 in turn communicating with an outer chamber 47 defined between the outer edge of distributor 41 and the inner edge of ring 38. Chamber 47 communicates with seats 21A, 21B, 21C and 21D via suction means consisting of radial channels 49 formed through ring 38, and is defined on one side by a portion 50 over the outer edge of which the inner surface of ring 38 slides in substantially contacting manner. Said portion 50 is located at the point of tangency between roller 20 and a transfer roller 51, which, as regards the innermost portion and the main peripheral chamber, is substantially similar to roller 14. The function of said portion 50 is to successively cut off communication between each seat 21A, 21B, 21C, 21D and central passage 42 as each said seat moves through the point of tangency between rollers 20 and 51.

A partition 55 on the other side of chamber 47 separates this from a further chamber 56, which is completely isolated from central passage 42 and located at the point of tangency between rollers 20 and 14. Via an axial duct 57 formed through distributor 41 and an electrovalve 58 (for enabling selective withdrawal as described in more detail later on), chamber 56 communicates with a suction duct 59 communicating with a suction device (not shown).

As shown in FIG. 1, each seat 21A, 21B, 21C and 21D on roller 20 is assigned a respective, e.g. inductive, sensor 60A, 60B, 60C and 60D integral with ring 38 and moving with the same about a circular route, one portion of which, at the point of tangency between rollers 14 and 20, is governed by signal emitting means comprising a fixed block 61 consisting, for example, of a metal element.

Roller 51 also comprises a rotary outer ring 123 having peripheral seats 115 for cigarettes 16 and turned anticlockwise by a central shaft 124 supporting two fixed cylindrical distributors 125 and 126, the first 125 of which is located inside the second 126 and communicates, via a central passage 127, with a suction device (not shown). Distributor 125 presents a through radial slot 143 communicating, on one side, with central passage 127 and, on the other, with a respective radial passage 145 in turn communicating with an outer chamber 147 defined between the outer edge of distributor 126 and the inner edge of ring 123. Chamber 147 communicates with seats 115 via suction means consisting of radial channels 149 formed through ring 123, and is defined on one side by a portion 150 over the outer edge of which the inner surface of ring 123 slides in substantially contacting manner. Said portion 150 is located immediately upstream (in relation to the rotation direction) from the point of tangency between rollers 51 and 20, wherein roller 20 presents portion 50, and therefore provides for automatically transferring cigarettes 16 by means of suction from roller 20 to roller 51. Said chamber 147 is defined on the other side by a similar portion 151 located at the point of tangency between roller 51 and a conveyor belt 211. The function of said portion 151 is to successively cut off communication between each seat 115 and central passage 127 as seat 115 moves through the point of tangency between roller 51 and conveyor 211, thus enabling automatic transfer of cigarettes 16. Said conveyor 211 presents a belt 212, the surface of which presents transverse seats 216 for housing cigarettes 16. Said belt 212 is located between two rollers 213 (one of which is powered) and runs over a supporting structure 214 in which is formed a longitudinal suction duct 215 with which seats 216 housing cigarettes 16 communicate via suction means consisting of central perpendicular channels 217 formed through belt 212.

Figure 5:
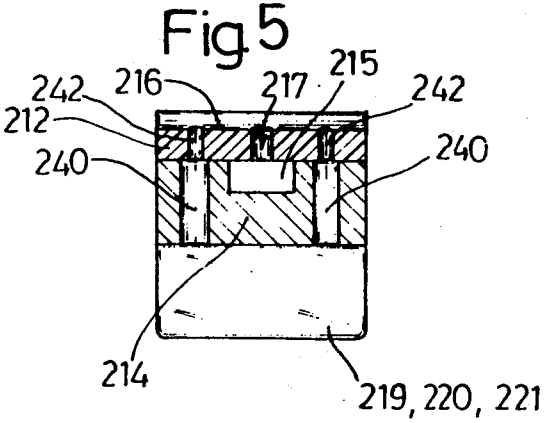
FIG. 5 shows a section along line V—V of the FIG. 4 component.
Figure 4:
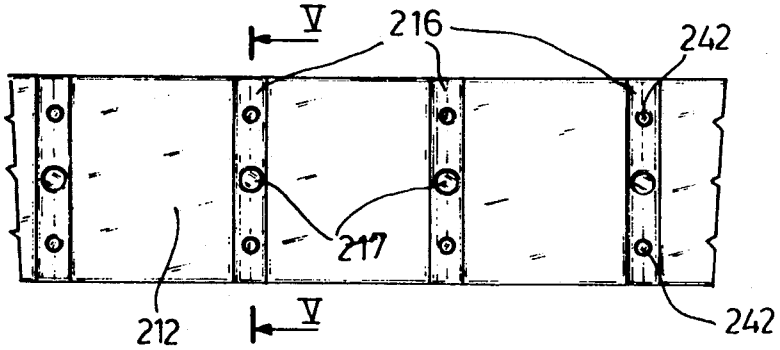
FIG. 4 shows a bottom view of a portion of a transportation component on the FIG. 1 apparatus.

As shown in FIG. 1, between top conveyor 211 and bottom conveyor 135, provision is made for three vertically parallel known units 230, 231 and 232, designed to perform individual checks of the physical and geometrical characteristics of cigarettes 16 (weight, diameter, ventilation, firmness, etc.). Said units 230, 231 and 232 present a respective top inlet located beneath respective sequential portions of the route of belt 212, and a respective bottom outlet located over layer 136 of cigarettes 16 on conveyor 135. At said outlets, each unit 230, 231, 232 presents a respective sensor 233, 234, 235, e.g. a photoelectric cell, designed to detect the passage of a cigarette 16 at the end of a respective inspection cycle. At the inlets of units 230, 231, 232, on the bottom branch of conveyor 211, provision is made for respective devices 219, 220, 221 for selectively picking cigarettes 16 off belt 212. As shown also in FIGS. 4 and 5, said devices 219, 220, 221 comprise a respective electrovalve connected to a compressed air source and communicating with two vertical through ducts 240 formed in structure 214. As belt 212 moves forward, said ducts 240 are so located as to match up with vertical holes 242 formed in belt 212 on either side of central channel 217, and to correspond at all times with seats 216 housing cigarettes 16.

Figure 6:
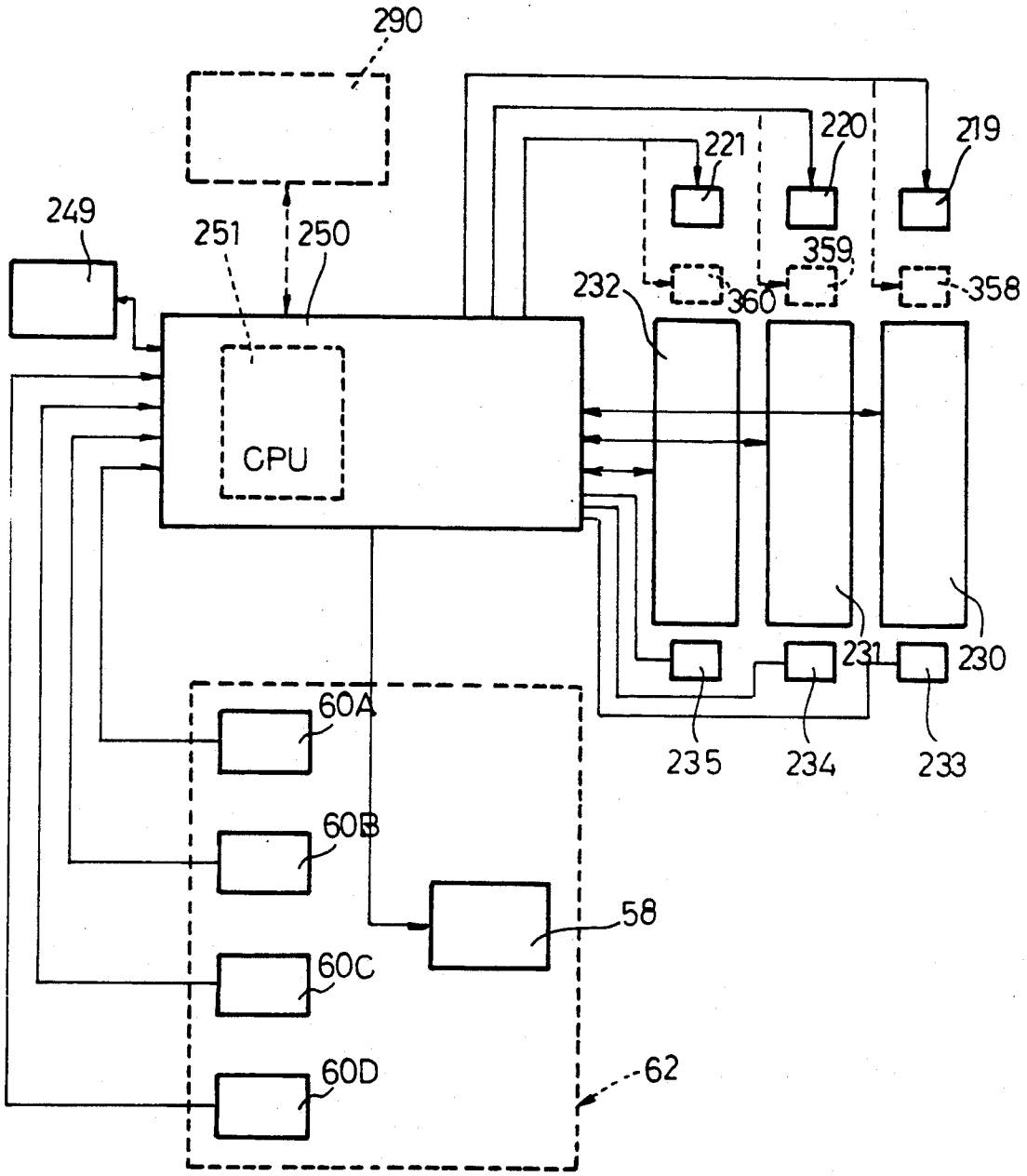
FIG. 6 shows a block diagram of the control system controlling the FIG. 1 apparatus.

Checking apparatus 101 is controlled by an electronic control system 250 comprising a central processing unit 251 (FIG. 6). Said control system 250 receives information output signals from respective sensors 60A, 60B, 60C, 60D as they move past element 61, and, depending on the operating mode (described in more detail later on) whereby cigarettes 16 are selectively withdrawn from roller 14, enables the control input of electrovalve device 58. Said elements combine to form a selective withdrawal control circuit 62.

Control system 250 also controls electrovalve devices 219, 220 and 221 for selectively supplying cigarettes 16 to checking units 230, 231 and 232; receives information signals from sensors 233, 234 and 235; and exchanges control and information signals with checking units 230, 231, 232, and with a block 249 controlling means for activating the various cigarette supply units, in particular rollers 14, 20 and 51 and conveyor belt 211, so as to supply control system 250 with a machine cycle count.

Control system 250 may also be connected to a computer 290 for controlling the entire cigarette manufacturing line.

Operation of the checking apparatus according to the present invention will be described with reference to the operating block diagram of processing unit 251 in FIG. 7.

In actual use, cigarettes 16 are fed successively by roller 14 to transfer unit 18, on to which they are normally unloaded unless selective withdrawal device 62 is activated by control system 250. On moving past partition 35, the suction through each seat 15 is reduced substantially to zero in preparation for withdrawal of cigarette 16 by roller 20, which is obviously only possible when one of seats 15 corresponds with one of seats 21A, 21B, 21C or 21D.

Figure 7:
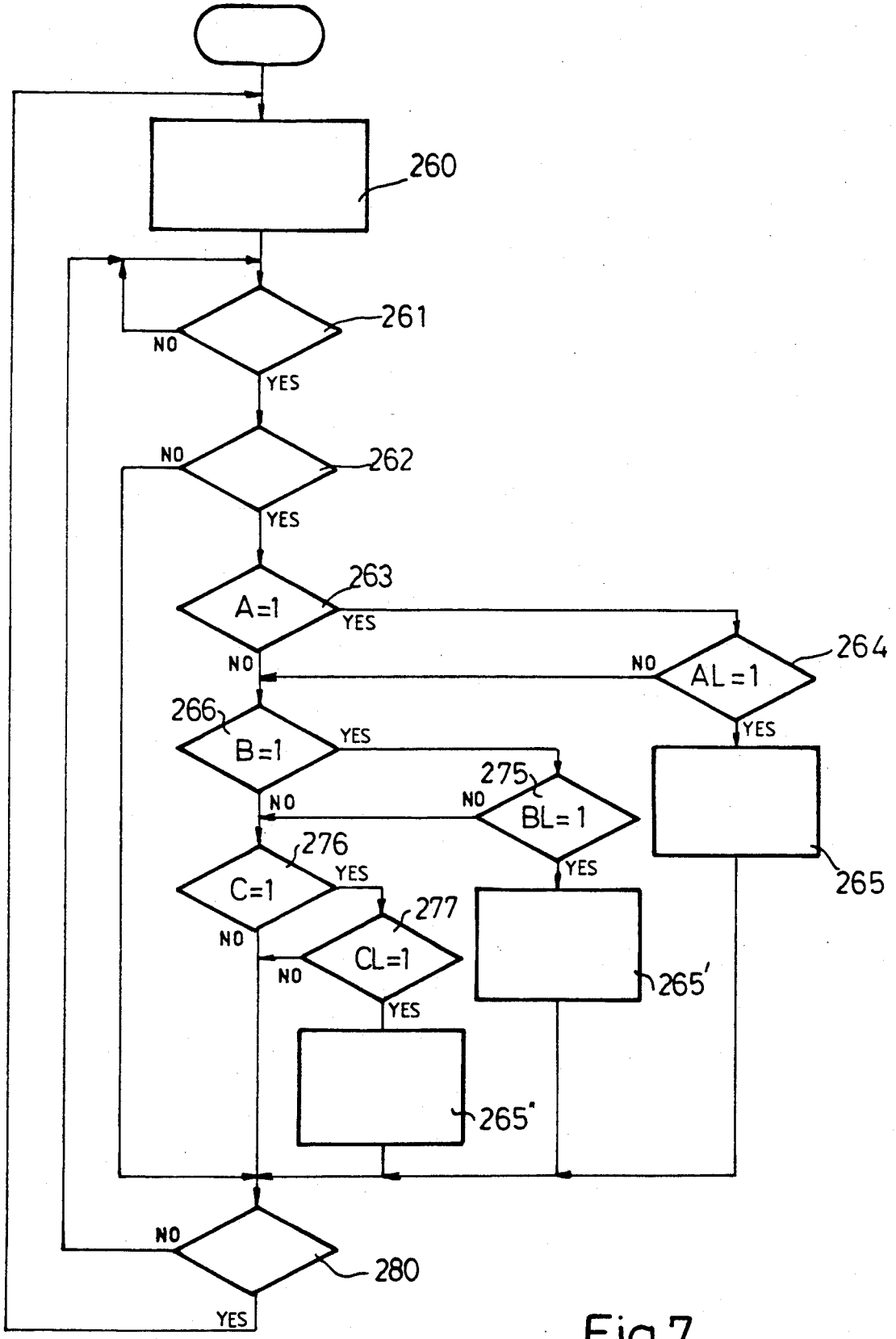
FIG. 7 shows an operating block diagram of a central processing unit on the FIG. 6 control system.

With reference to FIG. 7, the first step in the unit 251 program is block 260, which detects and the checking sequence and the type of check to be performed on each cigarette in the sequence, as set, for example, by the operator. The set checking sequence indicates which of cigarettes 16A, 16B, 16C or 16D is to be checked: one from half 10, 11, 12 or 13 (FIG. 2); a combination, e.g. of halves 10 and 11 or 12 and 13; or all four halves 10, 11, 12 and 13, etc. The set check type, on the other hand, indicates by which of units 230, 231 or 232 each type of cigarette is to be checked. As rollers 14 and 20 turn, control system 250 is supplied by control circuit 62 with a series of signals emitted by sensors 60A, 60B, 60C and 60D as respective seats 21A, 21B, 21C and 21D travel over an arc extending through the point of tangency between rollers 14 and 20. With reference to FIG. 7, block 260 goes to block 261, which determines whether a signal has been received from sensor 60A, 60B, 60C or 60D. In the event of a negative response, it switches back to the wait cycle; whereas, in the event of a positive response, it goes on to block 262, which determines whether the incoming signal is from the sensor assigned to the type of cigarette 16A, 16B, 16C, 16D to be checked. In the event of a positive response, block 262 goes on to block 263, which determines whether said type of cigarette is to be checked by first unit 230 (setting A=1). In the event of a positive response, block 263 goes on to block 264, which determines whether said unit 230 is free, i.e. is not already engaged in checking a previously sampled cigarette 16. This may be determined, for example, by examining the status of a digital signal AL indicating engagement or not of said unit 230. In the event of a positive response (unit 230 free, AL=1), block 264 goes on to block 265; whereas, in the event of a negative response, block 264, as also block 263, goes on to block 266.

Figure 8:
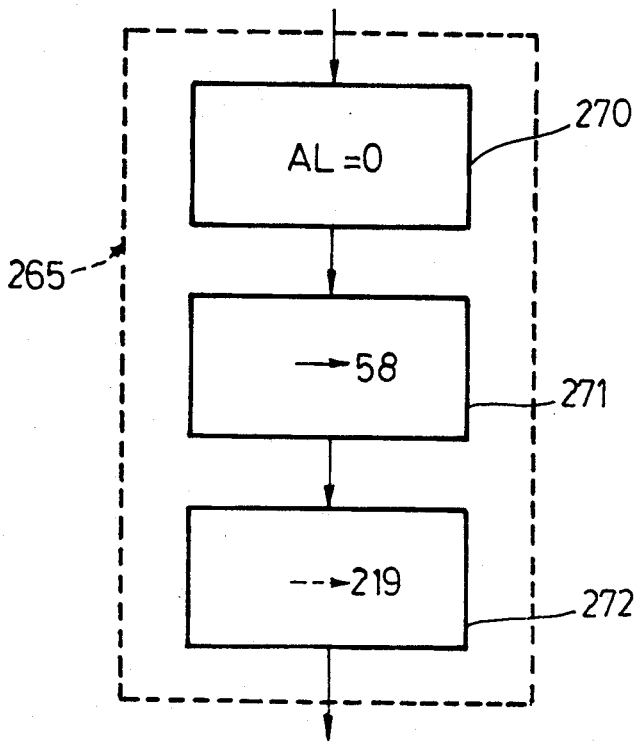
FIG. 8 shows a more detailed operating block diagram of a block in the FIG. 7 diagram.

As shown in FIG. 8, block 265 comprises:

a block 270 establishing a value AL=0 for said digital signal indicating engagement of checking unit 230;

a block 271 for determining the enabling signal of electrovalve 58;

a block 272, which provides for enabling electrovalve 219 of unit 230 with a delay equal to a given number of machine cycles and commencing from when electrovalve 58 is enabled A single machine cycle is known to correspond to a given angular excursion of a machine shaft (drive shaft) to which the means activating rollers 20 and 51 and roller 213 of belt 212 are connected.

Said electrovalve 58 controls transfer of cigarette 16 (in the set sequence type) on to roller 20 (FIG. 3). Thereafter, by virtue of the described internal suction system on rollers 20 and 51 and belt 212, whereby suction is cut off from one seat and applied in the mating seat on the tangent element, cigarette 16 is fed automatically from roller 20 to roller 51 and on to belt 212 by which it is fed, by virtue of the suction in central channel 217, to electrovalve 219. As the means activating rollers 20 and 51 and roller 213 of belt 212 are connected to said drive shaft, the machine cycle count for cigarette 16 to reach electrovalve 219 is known. Consequently, when said count (enabled by block 272) is reached, electrovalve 219 is activated by control system 250 and feeds compressed air through ducts 240 to lateral holes 242 of seats 216, thus releasing and dropping cigarette 16 into checking unit 230. This provides for performing a specific check of cigarette 16; exchanges phase and test finding signals with central processing unit 250; and, depending on the results of the check, either rejects cigarette 16 or feeds it through the outlet on to layer 136 on conveyor 135 by which it is fed to follow-up machine 103. As cigarette 16 drops through the outlet of unit 230, this is detected by sensor 23 and digital signal AL on control system 250 is set to 1, i.e. indicating that unit 230 is again free. The same applies even in the event of cigarette 16 being rejected. Block 266 (FIG. 17) determines whether the type of cigarette at the point of tangency between rollers 14 and 20 is to be checked in second unit 231 (setting B=1). In the event of a positive response, block 266 goes on to block 275, which determines whether unit 231 is free by examining the status of a digital signal BL indicating engagement of unit 231. In the event of a positive response (unit 231 free, BL=1), block 275 goes on to block 265' similar to block 265. In the event of a negative response, block 275, as also block 266, goes on to block 276.

Block 265' also comprises:

a block establishing value BL=0 for said digital signal indicating engagement of unit 231;

a block for determining the enabling signal of electrovalve 58;

a block which provides for enabling electrovalve 220 of unit 231 with a delay equal to a given number of machine cycles (obviously different from that of block 272) commencing from when electrovalve 58 is enabled. Block 276 determines whether the type of cigarette at the point of tangency between rollers 14 and 20 is to be checked in third unit 232 (setting C=1). In the event of a positive response, block 276 goes on to block 277, which determines whether said unit 232 is free by examining the status of a digital signal CL indicating engagement of unit 232. In the event of a positive response (unit 232 free, CL=1), block 277 goes on to block 265" similar to block 265. In the event of a negative response, block 277, as also block 276, goes on to block 280.

Block 265" also comprises:

a block establishing a value CL=0 for said digital signal indicating engagement of unit 232;

a block for determining the enabling signal of electrovalve 58;

a block which provides for enabling electrovalve 221 of unit 232 with a delay equal to a given number of machine cycles and commencing from when electrovalve 58 is enabled.

As regards the exchange of phase and test finding signals with central processing unit 250 and the definition of signals BL and CL from sensors 234 and 235 or units 231 and 232, units 231 and 232 operate in the same way as unit 230 already described.

As soon as the delay count commences for enabling electrovalve 219, 220 or 221, blocks 265, 265' and 265" (as well as block 262 in the event of a negative response) all go to block 280, which determines whether any change has been made to the set type of cigarette 16 to be checked. In the event of a positive, response, block 280 goes to block 260 for memorizing the new setting; whereas, in the event of a negative response, block 280 goes on to block 261 for detecting incoming signals from sensor 60A, 60B, 60C or 60D and so repeating the cycle described above Via electronic control system 250 and central processing unit 251, the checking apparatus according to the present invention therefore provides for automatically:

detecting the passage of a cigarette 16 through the point of tangency between rollers 14 and 20, i.e. in a suitable position for selective withdrawal for checking;

determining whether said cigarette 16 is of the type specified for checking;

determining the type of check to be performed and whether the unit designed to perform the same is free; in the event of a positive response, the apparatus according to the present invention also provides for automatically:

withdrawing cigarette 16 via electrovalve 58 and feeding it on to conveyor belt 211;

timing activation of one of electrovalves 219, 220 and 221 for selectively feeding cigarette 16 off conveyor belt 211 and into the selected unit 230, 231 or 232;

indicating engagement of the selected unit 230, 231 or 232 until cigarette 16 has been checked.

The advantages of the present invention will be clear from the foregoing description. In particular, routine flow of cigarettes 16 to follow-up machine 103 is substantially unaffected: only cigarettes 16 of the selected type/s are withdrawn, and only if the relative unit for performing the required check is free. Moreover, by virtue of said units 230, 231 and 232 being arranged vertically parallel between conveyors 211 and 135, parallel checks may be performed on several cigarettes, each of which is subjected solely to the type of check provided for by the selected unit, thus enabling a considerable reduction in checking time. Finally, any cigarettes not damaged during inspection are fed back on to layer 136 and to follow-up machine 103.

The cigarette and check type settings for block 260 may be entered by the operator, or automatically by processing unit 251, e.g. as a function of the test findings received from checking units 230, 231 and 232, or via computer 290. By means of computer 290, processing unit 251, given the origin of each sampled cigarette 16 and the difference between the test findings and required theoretical values, may provide for automatically correcting the appropriate production parameters for eliminating the faults detected by units 230, 231 and 232 and relative to cigarettes formed from halves 10, 11, 12 and 13. The data supplied to processing unit 251 for performing the above function is unquestionably valid by virtue of deriving from statistical analyses of a large number of samples, and by virtue of the accuracy of each check which is performed statically.

Figure 10:
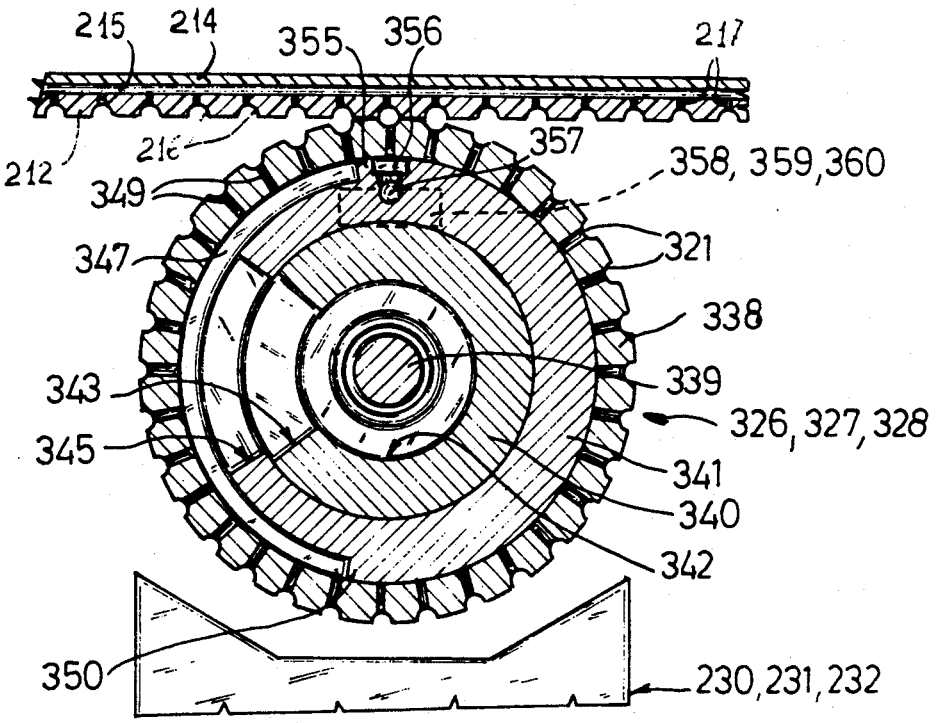
FIG. 10 shows a section of a component on the FIG. 9 apparatus.
Figure 9:
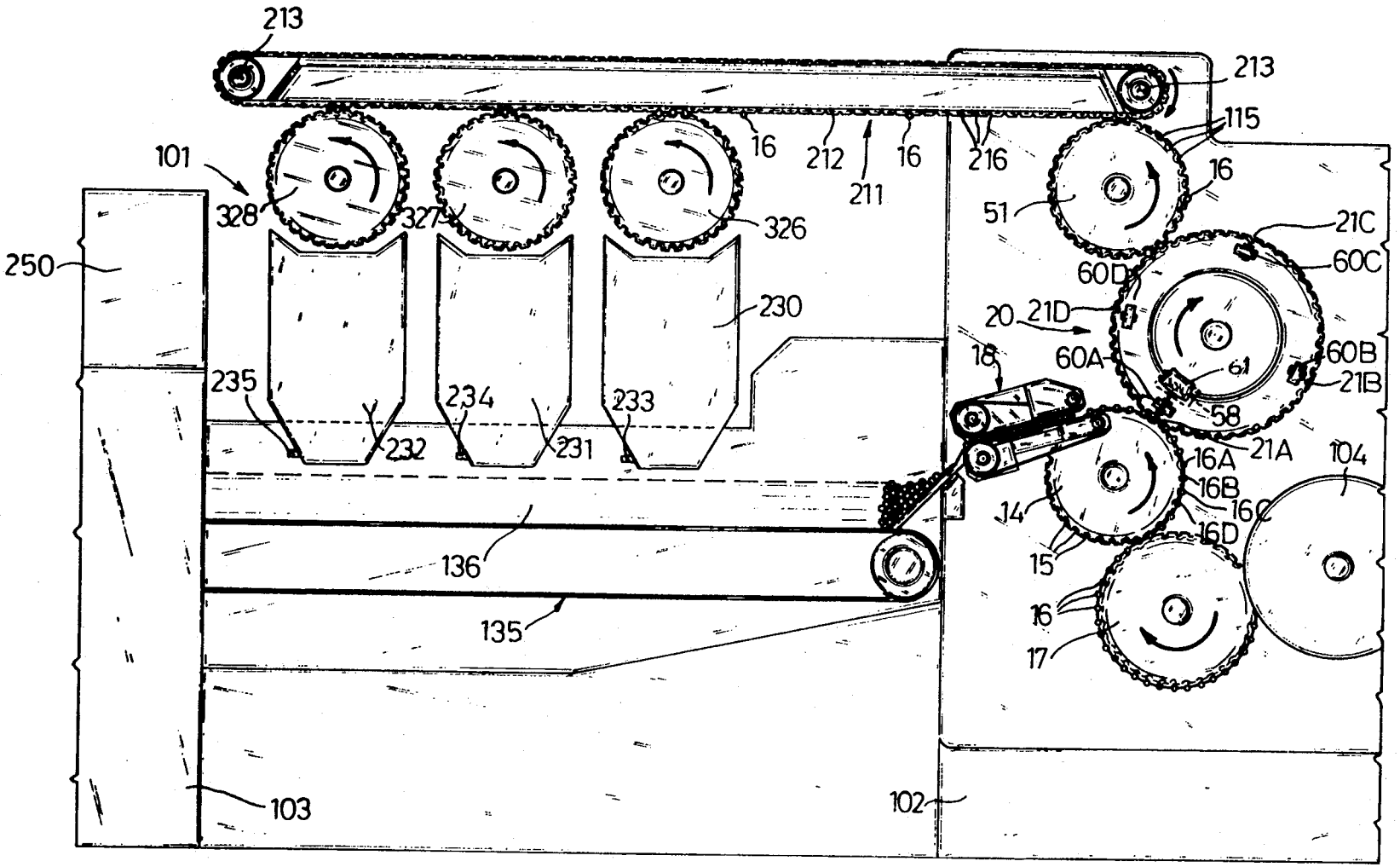
FIG. 9 shows a front view of an alternative embodiment of the apparatus according to the present invention.

FIG. 9 shows a variation of the checking apparatus according to the present invention. The only difference as compared with the FIG. 1 apparatus lies in the configuration of the means for selectively feeding cigarettes 16 off conveyor belt 211 to checking unit 230, 231 or 232. In the FIG. 9 embodiment, electrovalves 219, 220 and 221 are dispensed with and, between the top inlets of units 230, 231 and 232 and conveyor belt 211, provision is made for respective selective withdrawal rollers 326, 327 and 328 having an internal structure similar to that of roller 20. As shown in FIG. 10, each of said rollers 326, 327, 328 comprises a rotary outer ring 338 having peripheral cigarette seats 321 and turned anticlockwise by a central shaft 339 supporting two fixed cylindrical distributors 340 and 341. Distributor 340 is located inside 341 and communicates via a central passage 342 with a suction device (not shown) Distributor 340 presents a through radial slot 343 communicating, on one side, with central passage 342 and, on the other, with a respective radial passage 345 in turn communicating with an external chamber 347 defined between the outer edge of distributor 341 and the inner edge of ring 338. Chamber 347 communicates with seats 321 via suction means consisting of radial channels 349 formed through ring 338, and is defined, on one side, by a portion 350 over the outer edge of which the inner surface of ring 338 slides in substantially contacting manner. Said portion 350 is located at the bottom of roller 326, 327, 328, over the inlet of respective unit 230, 231, 232, and therefore provides for successively cutting off communication between each seat 321 and central passage 342 as seat 321 moves over the inlet of respective unit 230, 231, 232. A partition 355 on the other side of chamber 347 separates this from a further chamber 356, which is completely isolated from central passage 342 and located at the point of tangency between rollers 326, 327, 328 and belt 212. Via an axial duct 357 formed through distributor 341 and a respective electrovalve 358, 359, 360 (for each of rollers 326, 327, 328) for enabling selective withdrawal as described in more detail later on, chamber 356 communicates with a suction duct communicating with a suction device (not shown). As shown by the dotted lines in the top right-hand corner of the operating block diagram in FIG. 6, control system 250 therefore controls electrovalves 358, 359 and 360 as opposed to electrovalves 219, 220 and 221. The FIG. 9 apparatus operates in exactly the same way as that of FIG. 1 as regards the manner in which cigarettes 16 are selectively withdrawn by roller 20 and fed on to conveyor belt 211, and also as regards timed transfer of cigarette 16 from belt 212 into respective unit 230, 231 or 232 on the basis of a given number of machine cycles wherein cigarette 16 is fed from portion 35 of roller 14 to the respective portion of belt 212 tangent to respective roller 326, 327 or 328. Upon cigarette 16 reaching said point of tangency, control system 250 activates respective electrovalve 358, 359 or 360, so as to suck cigarette 16 out of seat 216 on belt 212 and into the adjacent seat 321 on ring 338 of respective roller 326, 327 or 328. Similarly, upon said seat 321 on anticlockwise-rotating ring 338 reaching said portion 350, the suction through said seat is cut off, thus causing cigarette 16 to drop down into unit 230, 231 or 232 underneath.

To those skilled in the art, it will be clear that changes may be made to the embodiments described and illustrated herein without, however, departing from the scope of the present invention. For example, changes may be made to the system whereby cigarettes 16 are selectively withdrawn from roller 14; to the system whereby cigarettes 16 are selectively fed to checking units 230, 231 and 232; to the number of said units; or to the operation of central processing unit 251. Also, instead of depending on unit 251 determining non-engagement of a respective checking unit, a predetermined type of cigarette 16 may be withdrawn periodically by roller 20, e.g. via a timing block allowing a sufficiently long interval to ensure inspection of any previously sampled cigarettes 16 has been completed.

I claim:

1. A cigarette checking apparatus for checking selected cigarettes from a succession of single cigarettes, comprising means for selectively withdrawing said selected cigarettes from first transportation means for transporting said succession of single cigarettes to first conveying means, means for transporting said selected cigarettes withdrawn from said first transportation means to second transportation means, said second transportation means transporting said selected cigarettes withdrawn from said first transportation means to at least one checking device said at least one checking device checking the physical and geometrical characteristics of said cigarettes, and said at least one checking device having an independent inlet receiving said selected cigarettes from said second transportation means.

2. The cigarette checking apparatus as claimed in claim 1, characterized by the fact that said at least one checking device comprise means for indicating whether or not they are in a condition to receive said selected cigarette.

3. A cigarette checking apparatus for checking selected cigarettes from a succession of single cigarettes, comprising means for selectively withdrawing said selected cigarettes from first transportation means for transporting said succession of single cigarettes to first conveying means, means for transporting said selected cigarettes withdrawn from said first transportation means to second transportation means, said second transportation means transporting said selected cigarettes withdrawn from said first transportation means to at least one checking device, said at least one checking device checking the physical and geometrical characteristics of said cigarettes, said at least one checking device having an independent inlet receiving said selected cigarettes from said second transportation means, said at least one checking device being located between said second transportation means and said first conveying means, and said at least one checking device having an outlet opening towards said first conveying means.

4. A cigarette checking apparatus for checking selected cigarettes from a succession of single cigarettes, comprising means for selectively withdrawing said selected cigarettes from first transportation means for transporting said succession of single cigarettes to first conveying means, means for transporting said selected cigarettes withdrawn from said first transportation means to second transportation means, said second transportation means transporting said selected cigarettes withdrawn from said first transportation means to at least two checking devices, said at least two checking devices checking the physical and geometrical characteristics of said cigarettes, each of said at least two checking devices having an independent inlet receiving said selected cigarettes from said second transportation means, and each of said at least two checking devices including a single unit for checking a specific characteristic of said cigarette.

5. A cigarette checking apparatus for checking selected cigarettes from a succession of single cigarettes, comprising means for selectively withdrawing said selected cigarettes from first transportation means for transporting said succession of single cigarettes to first conveying means, said means for selectively withdrawing cigarettes from said first transportation means having means for detecting a predetermined selective withdrawal position, means for performing such withdrawal, and means for transporting said selected cigarettes withdrawn from said first transportation means to second transportation means, said second transportation means transporting said selected cigarettes withdrawn from said first transportation means to at least one checking device, said at least one checking device checking the physical and geometrical characteristics of said selected cigarettes, and said at least one checking device having an independent inlet receiving said selected cigarettes from said second transportation means.

6. The cigarette checking apparatus as claimed in claim 5, characterized by the fact that said means for performing said withdrawal comprise an electrovalve located next to a respective roller for transferring said cigarettes from said first transportation means to said second conveying means, and designed to enable transfer of said cigarette by withdrawing air from a seat on said roller facing a respective seat on said first conveying means in which said cigarettes are being transferred.

7. The cigarette checking apparatus as claimed in claim 6, characterized by the fact that said roller has means for automatically transferring said cigarette from said seat to said second transportation means.

8. A cigarette checking apparatus for checking selected cigarettes from a succession of single cigarettes, comprising means for withdrawing said selected cigarettes from first transportation means for transporting said succession of single cigarettes to first conveying means, means for transporting said selected cigarettes withdrawn from said first transportation means to second transportation means, said second transportation means transporting said selected cigarettes withdrawn from said first conveyor means to at least one checking device, said at least one checking device checking the physical and geometrical characteristics of said selected cigarettes, said at lest one checking device having an independent inlet receiving said selected cigarettes from said second transportation means, and means associated with said second transportation means for selectively feeding said selected cigarettes to said independent inlet of said at last one checking device.

9. The cigarette checking apparatus as claimed in claim 8, characterized by the fact that said means for selectively feeding said selected cigarettes to said at least one checking device comprise electrovalves located next to said at least one checking device.

10. The cigarette checking apparatus as claimed in claim 9, characterized by the fact that said electrovalves are located next to a conveyor belt forming part of said second transportation means, and are designed to supply compressed air to a seat on said belt housing said cigarette.

11. The cigarette checking apparatus as claimed in claim 9, characterized by the fact that said electrovalves are located next to a respective roller for transferring said cigarettes from said belt of said second transportation means into one of said at least one checking device, and are designed to enable transfer of said cigarette by withdrawing air from a seat on said roller facing a respective seat on said conveyor belt.

12. The cigarette checking apparatus as claimed in claim 11, characterized by the fact that said roller presents means for automatically transferring said cigarette from said seat into said at least one checking device.

13. The cigarette checking apparatus as claimed in claim 8, characterized by the fact that it comprises means for detecting a specific sequence of cigarettes towards said first transportation means.

14. The cigarette checking apparatus as claimed in claim 13, characterized by the fact that it comprises an electronic control system for controlling said first means detecting the passage of cigarettes in said sequences through a position enabling withdrawal of the same from said first transportation means; for controlling said means enabling said withdrawal; and for controlling said means for selectively feeding said selected cigarettes to said at least one checking device.

15. The cigarette checking apparatus as claimed in claim 14, characterized by the fact that said control system comprises a central processing unit.

16. The cigarette checking apparatus as claimed in claim 15, characterized by the fact that said control system comprises means for setting the type of cigarettes to be checked and the type of check to be performed on the same; means for determining whether said cigarettes belong to said sequence; means for controlling said withdrawal means; and means for enabling delayed activation of said means for selectively feeding said cigarettes to said at least one checking device.

17. The cigarette checking apparatus as claimed in claim 16, characterized by the fact that said means for enabling said selective feeding means comprise means for counting the number of machine cycles from when said means enabling said withdrawal are enabled and said selected cigarette reaches the selected said at least one checking device.

18. The cigarette checking apparatus as claimed in claim 15, characterized by the fact that said at least one checking device is connected to said control system.

19. A cigarette checking apparatus for checking selected cigarettes of a succession of single cigarettes, comprising means for selectively withdrawing said selected cigarettes from first transportation means for transporting said succession of single cigarettes to first conveying means, means for transporting said selected cigarettes withdrawn from said first transportation means to second transportation means, said second transportation means transporting said selected cigarettes to at least one checking device, said at least one checking device checking the physical and geometrical characteristics of said cigarettes, said at least one checking device having an independent inlet for receiving said selected cigarettes conveyed along said second transportation means, and said at least one checking device having means for indicating whether or not said at least one checking device is in a condition to receive said selected cigarettes.

* * * * *